US006353453B1

(12) United States Patent
Lien et al.

(10) Patent No.: US 6,353,453 B1
(45) Date of Patent: Mar. 5, 2002

(54) THERMAL PRINTHEAD LOAD ADJUSTMENT MECHANISM

(75) Inventors: Brent D. Lien, Minneapolis; Kevin R. Campion, Minnetonka; Darren W. Haas, Eden Prairie, all of MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/479,563

(22) Filed: Jan. 7, 2000

Related U.S. Application Data

(60) Provisional application No. 60/115,017, filed on Jan. 7, 1999.

(51) Int. Cl.[7] ..... B41J 1/00
(52) U.S. Cl. ..... 347/198; 400/120.17
(58) Field of Search ..... 347/197, 198; 400/120.16, 120.17

(56) References Cited

U.S. PATENT DOCUMENTS 5,448,281 A * 9/1995 Walter et al. ..... 347/198
5,678,938 A * 10/1997 Saito et al. ..... 347/198
5,846,003 A * 12/1998 Mori et al. ..... 347/198
5,902,055 A * 5/1999 Oshino et al. ..... 347/197

FOREIGN PATENT DOCUMENTS

JP 6-320829 A * 11/1994
JP 8-34146 A * 2/1996

* cited by examiner

*Primary Examiner*—Daniel J. Colilla
(74) *Attorney, Agent, or Firm*—Westman, Champlin & Kelly, P.A.

(57) ABSTRACT

A mounting slider bracket for a card printer thermal printhead is supported between a spring and the printhead, and can be adjusted laterally relative to the printhead to shift the center of force that loads the printhead against the ribbon and a card that is being printed. The ability to change the location of the application of force on the printhead permits centering the force when a card of different width is fed from a supply through the printhead. Uniform printing will occur on cards regardless of the width, when properly adjusted by the operator.

15 Claims, 3 Drawing Sheets

THERMAL PRINTHEAD LOAD ADJUSTMENT MECHANISM

This application claims benefit of Prov. No. 60/115,017 filed Jan. 7, 1999.

BACKGROUND OF THE INVENTION

The present invention relates to a loading device for a thermal printhead so that the load on the printhead and thus the center of force urging the printhead against a thermal transfer ribbon and a substrate on which printing is to occur is controllable and adjustable.

Identification card printers are well known in the art. Dye sublimation and thermal resin printing technology are used to print a photo realistic image on an identification card or substrate made up of plastic or some similar material such as polyester, polyvinyl-chloride (PVC), or PETG.

In the card printing industry, a standard size card has been used by all printer manufacturers when designing the printers. Hoppers to hold cards, pinch or drive rollers to move the cards through the printer, ribbon size, and lamination stations all are designed with the standard size card size of 2.125 inches by 3.375 inches (known in the industry as a CR-80 size card). Some printers, such as the Fargo Electronics Inc. model 4250 have the capability to handle larger size cards, such as cards in sizes of 2.375 inches by 3.625 (known in the industry as a CR-90 card) and 2.625 inches by 3.875 inches (known in the industry as a CR-100 card).

In order to have good image quality, many factors must be designed into the printer. Printing is accomplished by the printhead pixels being fired or heated under control of an outside computing device. The pixels produce heat, and a dye sublimation or thermal resin ribbon is positioned between the printhead and the identification card. As the pixels are fired and heated, the dye on the ribbon releases from the carrier and is sublimated into the identification card, or in the case of thermal resin ribbon, the heat from the pixels causes the resin to release from the carrier and bond to the surface of the identification card. One of the factors in the design of the printer that must be carefully considered is that the printhead in the printer must maintain a suitable pressure on the ribbon and the card so that a uniform transfer of resin or dye is accomplished. If the pressure on the card is unequal across the width of the card, the heat generated by the firing of the pixels in the printhead will be uneven and will cause the dye to sublimate at uneven rates, which results in a card that is not uniform in terms of the print quality since the ink has sublimated or transferred unevenly. The end users of such cards will not accept such print quality.

Since most printers are designed simply to accommodate one size card, that of the CR-80, the manufacturers of the printer have opted to fix the position where the center of force is applied to the printhead to the center of the CR-80 card. In some cases, this option will also work for the larger CR-90 cards since the overall dimensions are not so significantly different from the CR-80 card as to prevent a reasonably even application of the dyes from occurring. However, this is not the case when the card sizes are smaller and vary from the CR-80 card size more widely than do the CR-90 cards. The present printer has the capability to print on varying sizes of card by permitting lateral adjustment of the center of force application.

The invention described is a mechanism that moves the pressure point of the printhead on a horizontal plane so that it can be adjusted to be flexibly centered on a blank identification card of any size as long as it will fit in the size parameters of the printhead.

SUMMARY OF THE INVENTION

The present invention comprises a laterally adjustable mounting for a printhead that permits accurate application of dye sublimation and resin images to a rigid plastic card by insuring that there is an even force distribution over the line on the printhead that engages the card. The mounting permits changing of the lateral position of the center of application of force on the thermal printhead to accommodate centering the force on rigid plastic cards of a variety of widths. The changing of the lateral position of the application force on the thermal printhead optimizes the performance of the thermal printhead printing mechanism for various widths of substrates.

DETAILED DESCRIPTION OF THE ILLUSTRATIVE EMBODIMENTS

Figure 3:
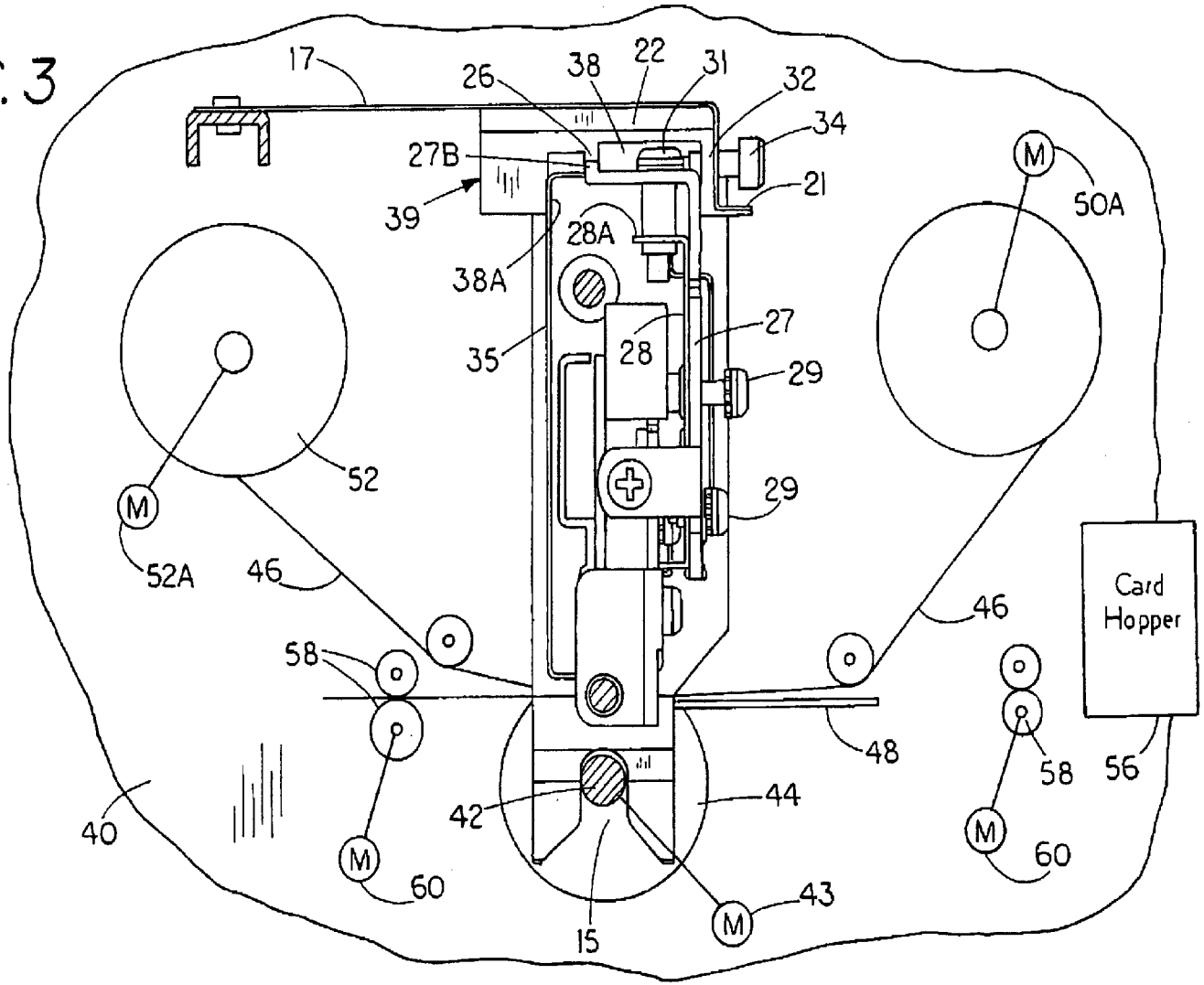
FIG. 3 is a side view of the printhead with a side mounting plate removed.

A thermal printhead 10 of an identification card printer, as shown in FIG. 3 in schematic form at 40 is typically mounted into a printer by attaching two- side mounting brackets 12 to the sides of the printhead 10 by a standard screw 13 and on the top of the printhead by a standard screw 31 designed to fit into screw slots made by the manufacturer of the printhead. The mounting brackets 12 have guide slots 15 and their lower ends allowing for the assembly of the printhead 10 and brackets 12 to be guided to a precise location by fitting over a shaft 42 of a platen 44 associated with the printhead. The assembly of the printhead 10 and the brackets 12 is attached to the printer by means of adjustable screws so that the assembly has the requisite space to allow a ribbon 46 and identification card 48 to pass between the printhead and the platen 44.

The ribbon 46 is wound on a roller or core 50 which is held in place by two endcaps on springs which allow the core to be inserted or removed easily from the printer 40. A second core 52 is used to take up the ribbon, and is positioned on a second set of endcaps and also on springs so that the core can be removed. The ribbon cores have a direct current motor 50A and a friction device with an angular sensor 52A attached to drive shafts for the cores to move the ribbon forward and the ribbon motion is controlled and predictable. A computer is used for control of the ribbon in a typical printer arrangement well known in the art, for example, in card printers made and sold by Fargo Electronics, Inc. of Eden Prairie, Minn., the assignee of the present application.

An identification card 48 is moved from a card hopper 56 and to and from the printhead by a series of pinch and drive rollers 58 which are driven by stepper motors 60, in a normal manner. The cards can be driven both forward and rearward, using rollers driving in the manner disclosed in U.S. Pat. No.

5,941,522. Since the ribbon 46 has panels of each printing color (cyan, magenta, yellow, black), card 48 is moved forward as each color panel is printed and then backward to its original starting position so the next panel of color can be applied.

Figure 1:
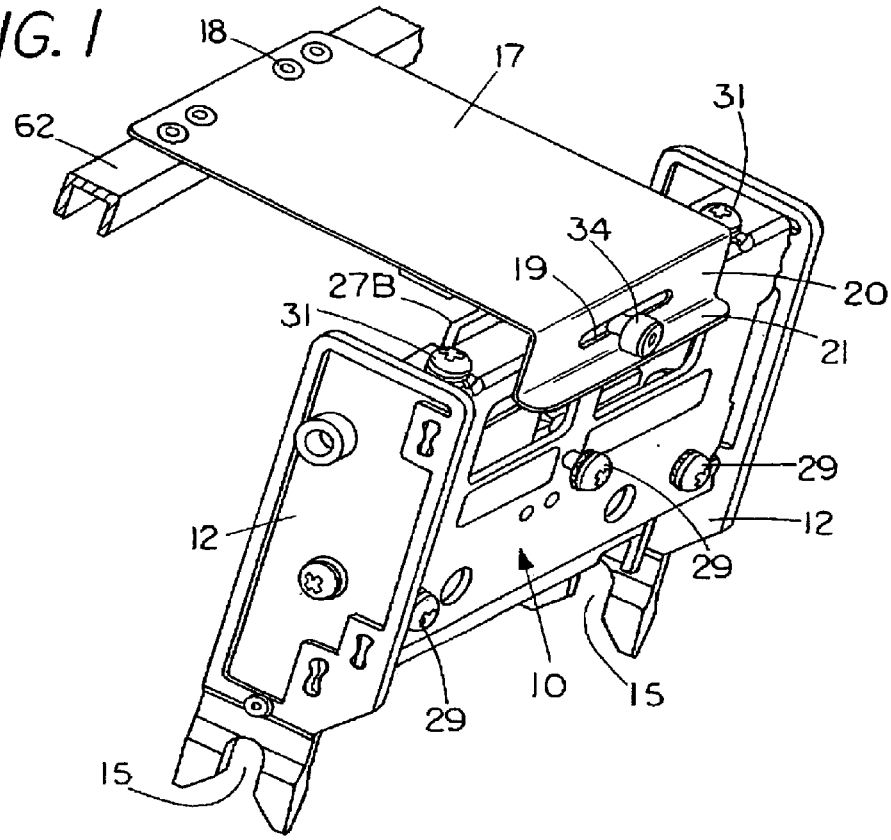
FIG. 1 is a perspective view of a printhead including a mounting of the present invention.
Figure 2:
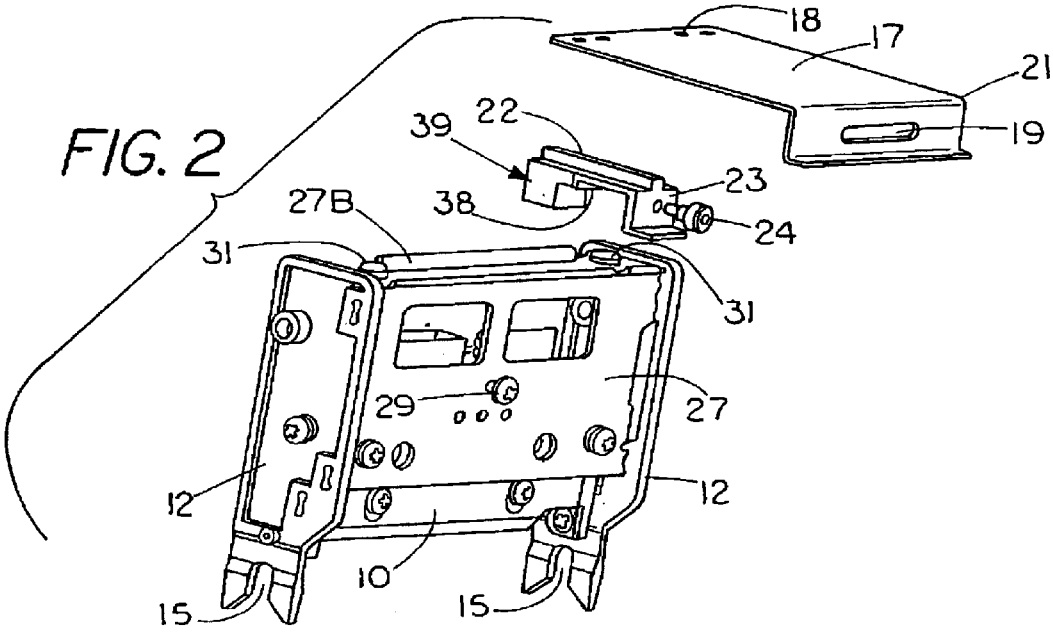
FIG. 2 is a view similar to FIG. 1 with the parts for mounting exploded for showing details of the invention.

Platen 44 acts as a feed roller and is driven with a motor 43, to move the card 48 and provide the base or reaction surface on which the card 48 rests while the printing takes place. In order to put pressure on the printhead so that it is held against the ribbon 46 and the card 48 when printing with a sufficient force, a leaf spring 17 is mounted to exert a force on the top of the printhead 10 and has a base end attached to a cross member 62 on the printer frame, in a suitable manner. The spring 17 is a flat, cantilever spring, as shown in FIGS. 2 and 3, and is made of a metal or other rigid spring material. Mounting holes 18 are used at the base end for attaching it to the cross member. The other or free end of the spring 17 is bent at a 90° angle to form a flange 20 with a transverse or lateral mounting slot 19 cut into the flange. A second flange or lip 21 is also formed at the lower edge of the flange 20 so that the end of the spring faces away from the printhead.

A loading bracket 39 is formed as a slider that can be moved laterally relative to the printhead, and which is positioned to transfer loads from the spring to the printhead 10 for printing. The slider or bracket 39 has a narrow top rib 22 that has a narrow top edge, as shown, and which is engaged by the spring 17. The only load transferred from the spring 17 to the slider or bracket 39 is through this top rib 22, which is centered in a longitudinal direction of the slider or bracket 39. The slider or bracket 39 also has a recess 38 that is of size to receive the upper portions of the printhead. A surface 38A is formed at one end of the recess 38 and provides a guiding surface along the backside of a plate 35 which is positioned at the backside of the printhead 10, and is secured in place on the printhead.

Figure 4:
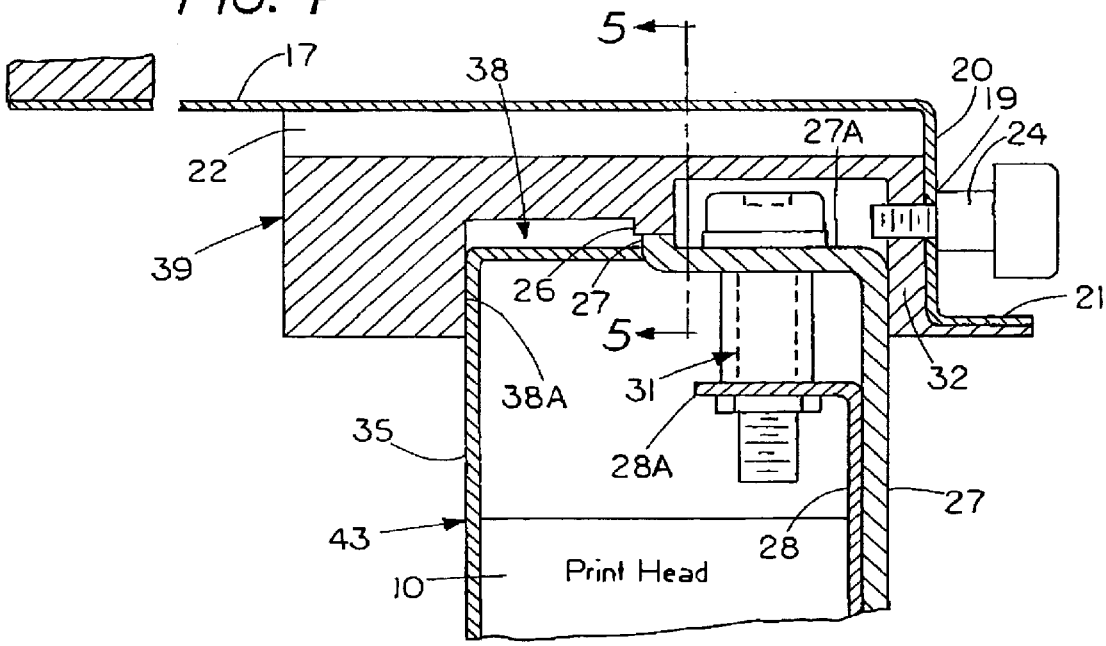
FIG. 4 is a fragmentary enlarged sectional view of the force applying components.
Figure 5:
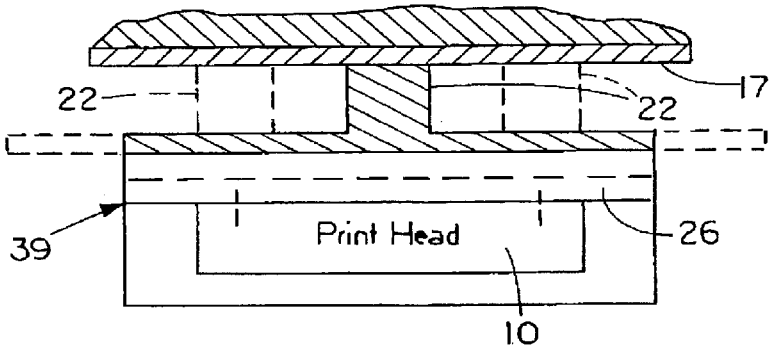
FIG. 5 is a sectional view taken on line 5—5 in FIG. 4.

It can be seen in FIG. 5 that the rib 22 is thinner than the full width of the slider or bracket 39, and juts upwardly from the bracket so that the spring 17 only contacts the top of the rib 22. This rib 22 is positioned perpendicular to the printhead and parallel to the direction of movement of the ribbon 46 and identification card 48. The slider or bracket 39 has a forward slider portion 32 that fits against the flange 20 of the spring 17, as shown in FIGS. 3 and 4. The slider or bracket 39 also has a loading rib or flange 26 in recess 38 that extends from the top surface of the recess downwardly farther than other portions of the recess walls, and is used for transferring spring loads to the printhead. The rib 26 extends transversely along the width of the bracket, as can be seen in FIG. 2.

In order to transfer the loads from the rib 26 to the printhead itself, the printhead has two mounting plates 27 and 28 which are shown in FIGS. 3 and 4. These plates 27 and 28 are formed so that they are contiguous, and held tightly onto the printhead frame with suitable mounting screws 29 and 31. The plates 27 and 28 have flanges 28A and 27A that extend over the printhead and which fit into the recess 38 that is formed in the slider or bracket 39. The flanges 27A and 28A are held together with a screw assembly 31 that holds the top of the printhead 10 steady together so that with the plate 35 there is a rigid structure around the printhead 10. When it is mounted, the assembly of the plates 27 and 28 allows the printhead to apply pressure along the length of the printhead.

The rear plate 35 connects to the front bracket 27 to provide an outer framework 29A around the printhead, so that there is a secure mounting.

As stated, the framework 29A and printhead 10 fit inside the recess 38 of the slider or bracket 39, so that the bracket 39 can slide along the frame 29A, with the loading flange 26 bearing against surfaces of the frame such as an upturned rib 27B on plate 27, to provide the load application line.

A shouldered screw or bolt 24 threads into the front slider portion 32 of the slider or bracket 39. The screw or bolt 24 extends through the slot and can be used as a guide for the slider, as well as providing end stops. If desired the screw can be tightened lightly to hold the flange 20. The friction of the flange against the front surface of the slider flange 32, will hold the slider bracket 39 adequately relative to the spring 17 in a desired, adjustable lateral position along the slot 19. In each case it is held by friction and no tools are required. A retainer projection can be molded into the slider either on the front or on the top that would be a guide through a slot with the force or the spring creating enough friction to hold the slider.

Since the flange 26 extends in a downward direction from the rest of the slider or bracket 39, it is the sole mechanism for transferring pressure or force from the spring 17 to the printhead 10.

By laterally shifting the slider or bracket 39 along slot 19 and tighten screw 24, the application line of the spring load for printing applied by the spring 17 onto rib 22 is changed along length of the printhead, and can be made to be off center if desired. Since the cards that are printed are guided along one edge of the printhead 10, the slider or bracket 39 can be moved laterally so the rib 22 is centered above the card 48 that is moving under the printhead 10, and permit the operator to center the load or force applied through the rib 22 and flange 26 onto the printhead over the center of the card. The spring will bear against the slider and provide a friction load sufficient to hold the slider without a screw, if desired.

Figure 6:
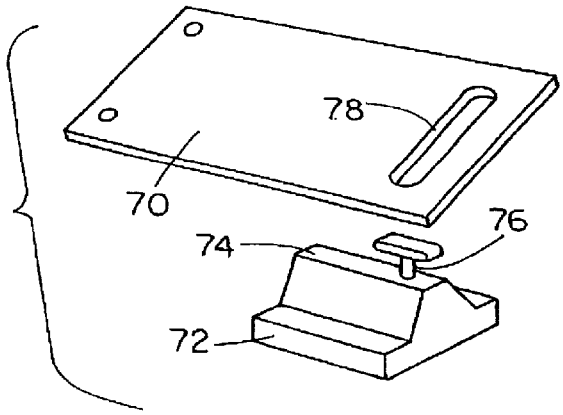
FIG. 6 is a schematic representation of another way of guiding the slider relative to the spring.

In FIG. 6, a modified form of the invention is shown and comprises a flat spring 70 that can be mounted as previously shown onto the framework, and can be used against a slider 72 that works as in the previous form of the invention as well. The slider 72 has a rib 74 in the center, and a molded in headed fastener 76 that extends upwardly, and which can be received in a slot 78 in the spring 70. The fastener can have a head that is narrow in one direction and long in the other, and then can be placed through the slot 78 and then the spring twisted 90° to hold the fastener in place in the slot. The molded fastener 76 does not exert any tightening force, but the force of the spring bearing against the rib 74 exerts the force onto the printhead as previously described, and the friction between the two parts will hold the slider adequately until it is manually shifted. The spring 70 provides an adequate downward pressure in this manner.

The main reason for the slots 78 and 19 is so that the slider is retained during head replacement and to provide end stops for the slider at the extreme ends of the slider travel.

The operator can quickly change the position of the slider or bracket 39 over the length of the top of the printhead bracket and rib 27B. Again the flange 20 is not needed on the spring as shown in FIG. 6.

By doing the adjustment, the printhead pressure can be applied to the center of a card that is not the standard CR-80 card size, as well as to the center of the standard size card.

The amount of movement of the slider or bracket 39 is controlled by the length of slot 19, and is adequate for accommodating centering the force along the lateral width of cards presently in existence.

Although the present invention has been described with reference to preferred embodiments, workers skilled in the art will recognize that changes may be made in form and detail without departing from the spirit and scope of the invention.

What is claimed is:

1. A mounting mechanism for applying pressure to a printhead that has a print line along a selected axis, the mounting mechanism comprising a frame, a spring supported on the frame, the spring having a portion in registry with the printhead, and a slider adjustably secured to the spring and having a portion for engaging the printhead and exerting a spring load onto the printhead, said slider being adjustable relative to the spring for positioning the slider at selected locations for exerting the spring load along the axis of the printhead.

2. The mounting mechanism of claim 1, wherein said slider has a narrow rib extending perpendicular to the axis of the printhead for engaging the portion of the printhead for exerting the force from the spring to the printhead.

3. The mounting mechanism of claim 1, wherein said slider has a rib that extends perpendicular to the selected axis of the printhead, the rib having a narrow surface engaging the spring, the narrow surface being the sole surface for transferring force between the spring and the slider.

4. The mounting mechanism of claim 3, wherein said printhead has a framework including side wall portions and a top portion, the slider being spring loaded against the top portion.

5. The mounting mechanism of claim 4, wherein said slider has a recess for receiving an upper portion of the framework of the printhead.

6. The mounting mechanism of claim 5, wherein said recess in the slider forms a slider flange, the spring being a leaf spring, a slot formed on the leaf spring facing the slider flange, and a member extending through the slot and secured to the slider.

7. The mounting mechanism of claim 1 and means providing a friction force to retain the position of the slider relative to the spring.

8. The mounting mechanism of claim 1, wherein said spring is a flat leaf spring and has a slot for receiving a retainer member to limit travel of the slider.

9. The mounting mechanism of claim 1, wherein said spring is a leaf spring that has a plane, a flange extending substantially perpendicular to the plane of the leaf spring, and the flange being positioned to one side of the slider, a slot formed in the flange extending parallel to the printhead axis, and a member in the slot secured to the slider.

10. A printhead mounting comprising a leaf spring having a lateral width in an axial direction of a printhead, and formed as a cantilever with one end of the leaf spring mounted onto a printer frame supporting the printhead, and a free end of said leaf spring being positioned to apply a force onto the printhead, a slider mechanism for movement in direction of the width of the leaf spring, the slider being adjustably connected to the leaf spring and securable at selected lateral positions, the slider being positioned to rest against the printhead.

11. The printer mounting device of claim 10, wherein said slider has a rib extending perpendicular to an axis of the printhead and wherein the leaf spring rests against the rib to provide a force for urging the slider toward a printhead.

12. The printer mounting device according to claim 10, wherein said leaf spring has a flange bent at substantially 90° to the plane of the leaf spring, a slot being mounted in the flange, and the slider having a surface that rests against the flange, and a retainer extending through the slot and secured to the slider.

13. A combination printhead and spring loading device for urging the printhead toward a platen and supported substrate, the device comprising a printhead having a frame with an upper end portion, a surface on the frame, a slider mounted for sliding in a direction generally parallel to a print line formed by said printhead, and a spring for loading said slider against the surface of the frame, including an adjustable connector for permitting lateral movement of the slider relative to the spring and adjustably fixing the slider to the spring to change the center of force exerted by the spring on the printhead.

14. The device of claim 13, wherein said slider has a narrow rib on an upper surface thereof, and said spring engages the narrow rib and has a surface that will permit lateral movement of the slider.

15. The device of claim 13, wherein said spring is a leaf spring having a surface, a narrow rib on the slider engaging the surface, and the spring having a slot therein for receiving a fastener comprising the adjustable connector that passes through the slot and secures the slider relative to the leaf spring.

* * * * *